United States Patent [19]

Levin

[11] 4,030,684

[45] June 21, 1977

[54] YARN TENSIONING DEVICE

[76] Inventor: Nathan Levin, 416 Highgate Drive, Trenton, N.J. 08618

[22] Filed: July 3, 1975

[21] Appl. No.: 592,871

[52] U.S. Cl. ..... 242/152.1
[51] Int. Cl.[2] ..... B65H 59/22
[58] Field of Search ..... 242/152.1, 147 R, 149

[56] References Cited

UNITED STATES PATENTS

| | | | |
|---|---|---|---|
| 2,373,513 | 4/1945 | Stevenson | 242/152.1 |
| 3,753,535 | 8/1973 | Zollinger | 242/152.1 |
| 3,874,613 | 4/1975 | Zollinger | 242/152.1 |
| 3,892,371 | 7/1975 | Zollinger | 242/152.1 |

FOREIGN PATENTS OR APPLICATIONS

| | | | |
|---|---|---|---|
| V2,200,072 | 8/1973 | Germany | 242/152.1 |

*Primary Examiner*—Stanley N. Gilreath

[57] ABSTRACT

A yarn tensioning device for the continuous application of uniform tension to yarn of indefinite length as it runs through the device, the latter being of the type in which a freely rotatable ball serves to apply the tension to the yarn. The device has a housing with a cylindrically shaped yarn passageway extending vertically therethrough when the device is in use and in which a pair of spaced ceramic yarn eye guides are positioned. A ball is positioned in the passageway between the inserts so as to be seated atop the opening in one of the inserts. The diameter of the passageway is uniform between the inserts and the wall of the housing is provided with an aperture extending therethrough so that the yarn may be threaded through the aperture and through each of the inserts thereby to thread the device with the yarn extending through the passageway and around the ball.

7 Claims, 6 Drawing Figures

YARN TENSIONING DEVICE

Figure 3:
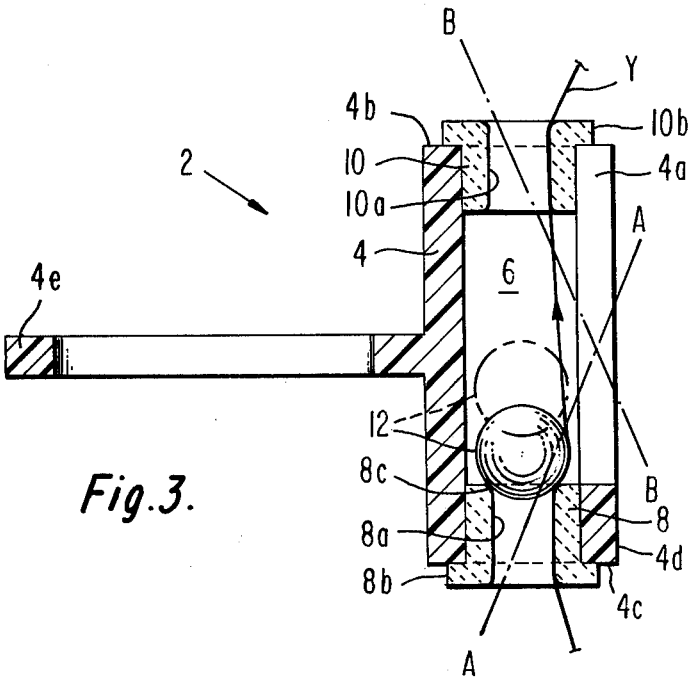

The present invention relates generally to the art of yarn tensioning and more particularly to an improved device for the continuous application of uniform tension to yarn of indefinite length as it runs through the device, the device being of the type wherein a ball serves to apply the tension to the running yarn.

Examples of such prior art devices are shown and described in the U.S. Pat. Nos. 3,753,535 and 3,874,613 to Zollinger.

As disclosed in said patents, the device has a housing with a cylindrically shaped yarn passageway extending therethrough, and with the passageway having sections of varying diameters. The function of the varying diameter sections of the passageways is to provide for positioning a ceramic yarn eye insert within the passageway at the lower end thereof, for restraining lateral movement of a ball within the passageway so that it remains seated atop the insert, and for readily threading the device with the yarn to be tensioned thereby.

It is a principal object of the invention to provide a ball type of yarn tensioning device with a housing having a cylindrically shaped yarn passageway of generally uniform diameter extending therethrough, wherein spaced ceramic yarn eye inserts are positioned within the passageway adjacent the lower and upper ends thereof, and wherein a ball is disposed within the passageway in the space between the inserts, the ball being retained in seated position atop the lower insert by the interior surface of the passageway.

It is a further object of the present invention to provide means whereby the aforesaid yarn tensioning device may be readily threaded with the yarn to be tensioned thereby, such means comprising a suitably positioned opening of restricted size extending through the wall of the housing into the yarn passageway in such manner that the yarn may be readily threaded through the opening and the upper insert and through the opening and the lower insert whereby the yarn so threaded will extend through the inserts, through the passageway and around the ball therein.

With the above and other objects in view which will become apparent from the following detailed descriptions of several embodiments of the invention shown in the accompanying drawings, the present invention resides in the novel elements of construction and arrangement of parts of the yarn tensioning devices illustrated and as pointed out in the claims.

Figure 1:
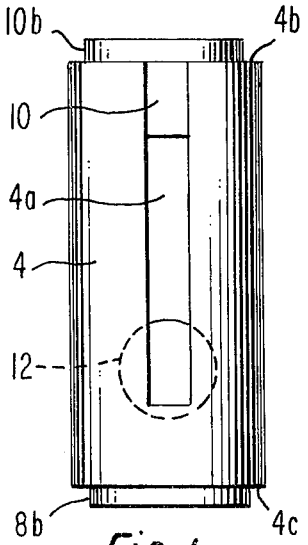
Figure 2:
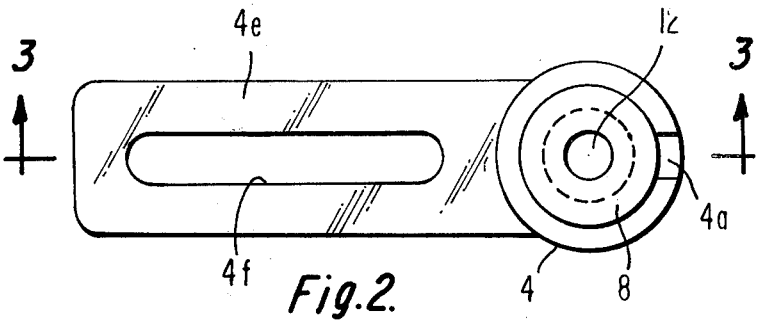

In the drawings:

FIG. 1 is a front elevational view of the yarn tensioning device of the present invention, FIG. 2 is a top plan view of the device shown in FIG. 1, FIG. 3 is a side cross-sectional view in elevation of the device of the present invention, as taken on line 3—3 of FIG. 2, and FIGS. 4, 5 and 6 are views similar to FIG. 3 showing first, second and third modifications of the present invention, respectively.

As shown in FIGS. 1, 2 and 3, the yarn tensioning device of the present invention is indicated generally at 2 in the upright position in which it is used. The device may be employed upon or in conjunction with the operation of any type of machine with which running yarns are used, such as knitting machines or the like.

The device is provided with a tubularly shaped housing 4 enclosing therein a cylindrically shaped passageway 6 for the running yarn, the passageway extending completely through the housing and being open at both ends thereof. The housing is provided with a suitably positioned opening of suitable restricted size, for a purpose to be described, and which, in the present instance, is in the form of a vertically disposed slot **4*a* located at and extending through the wall of the housing at the front thereof. The slot extends from the upper end 4*b* of the housing to a point short of the bottom 4*c* of the housing thus leaving the latter with a solid ring 4*d* at its lower end. The device is provided with a bracket 4*e* extending rearwardly from the housing and having an elongated slot 4*f*** formed therein, and by means of which the device may be adjustably mounted upon any suitable surface in the suitable relation to the yarn to be tensioned thereby.

A tubularly shaped ceramic yarn eye insert 8 having an uniterrupted yarn passageway **8*a* extending therethrough is recieved within the passageway 6 and inside the ring portion 4*d* of the housing at the lower end thereof. The insert 8 has a shoulder 8*b* at its lower end and which abuts lower end 4*c* of the housing. A similar insert 10 having an uniterrupted yarn passageway 10*a* extending therethrough is received within the upper portion of passageway 6 with its shoulder 10*b* abutting upper end 4*b* of the housing. While the inserts have been shown as having shoulders, other inserts without such shoulders may also be used. The inserts may be secured within the housing by a force fit into passageway 6, by being glued therein, or by any other suitable means. Should insert 10 be force fitted into the upper end of passageway 6, it will spread the housing apart on both sides of slot 4*a* and insert 10 will thus be yieldingly retained in position by the housing itself. The housing, and its mounting brackets, may be formed of any suitable material, such as plastic or the like, which is sufficiently resilient as to resist breakage thereof in the event that the inserts are force fitted into passageway 6** of the device.

A ball 12 is adapted to be seated in and to seal off the opening at the upper end of passageway **8*a* of insert 8, the upper end of such passageway in contact with the ball being rounded as at 8*c*. The ball, preferably of hardened stainless steel, is of a predetermined weight and of a predetermined diameter relative to the diameters of passageway 6 of the housing and of the uninterrupted seat 8*c* of insert 8. The weight of the ball is related to the amount of tension applied thereby to a yarn Y, FIG. 3, as it passes from its source upwardly through the device, passing through passageway 8*a* of insert 8, passing between seat 8*c* of insert 8 and ball 12 resting upon and applying tension to the running yarn, passing around the ball and through passageway 6 of the housing, and passing through passageway 10*a* of insert 10, to its destination. The diameter of the ball may vary, within limits, so long as it is sufficiently greater than the diameter of passageway 8*a* of insert 8 so that the ball can be seated atop the latter, and so long as it is sufficiently less than the diameter of passageway 6 of the housing so that its interior surface will sufficiently restrain lateral movements of the ball so that the force of gravity acting upon the ball will cause it to remain seated atop insert 8. It will be noted that there is sufficient room, in passageway 6 above the seated ball and below insert 10**, for the insertion of at least one additional ball, as may be desired to increase the tension upon the yarn.

The device may be readily threaded, with the inserts 8 and 10 in place, with a relatively thin elongated instrument having a hook at one end thereof, such as a latchless knitting needle. The instrument is inserted, along line A—A of FIG. 3, through slot 4*a* and passageway 8*a* of insert 8, to engage the yarn and, as the instrument is withdrawn, to pull the yarn through insert 8 and the slot, then the instrument is inserted, along line B—B, through passageway 10*a* of insert 10 and slot 4*a* to engage the yarn and, as the instrument is withdrawn, to pull the yarn through insert 10 and the slot, thereby threading the device. It will be obvious that the order, as well as the direction of, pulling or pushing the yarn through the device along the lines A—A, B—B, may be varied. The ball will be moved upwardly, to its position shown in dotted lines, as it is displaced by the instrument moving along line A—A. While the width of slot 4*a* is sufficient to permit passage of the yarn and of the instrument, it is not sufficient to permit passage of the ball therethrough. The presence of the slot does not prevent the restraint of the lateral movements of the ball.

Figure 4:
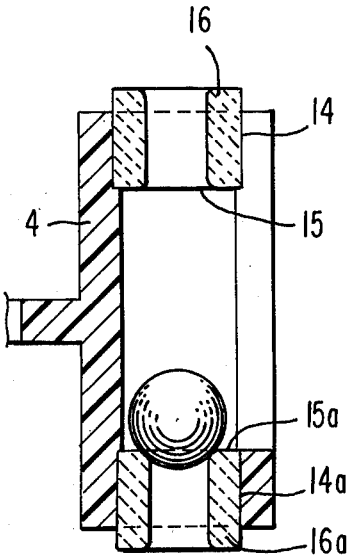

In the modification of FIG. 4, the internal diameter of the housing, at the upper end of its passageway, has been increased slightly, as at 14, thereby to provide an annular shoulder 15 therein. A straight sided and shoulderless ceramic yarn eye insert 16 is received into such increased diameter section 14 and rests upon the shoulder 15 thereof.

Figure 5:
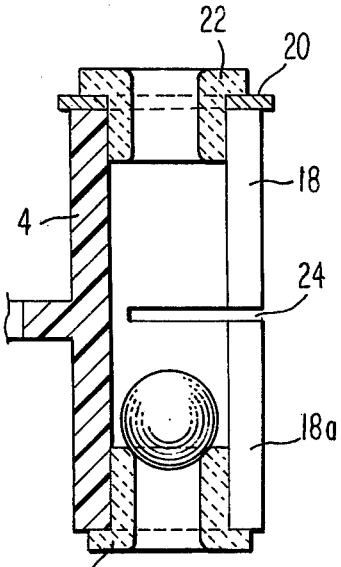

In the modification of FIG. 5, the housing is provided with a relatively narrow transversely extending slot 24 midway of its length and the vertical slot in the housing is extended for the full length thereof, as at 18, 18*a*. A relatively thin disc 20 having a suitable aperture therein is received between a ceramic yarn eye insert 22 and the upper end of the housing, as an aid in removing the insert. The diameter of the disc is larger than that of the housing. A lower ceramic yarn eye insert 26 may also be force fitting into and retained in place in the housing by the resiliency of the upper and lower halves of the housing to act individually upon the inserts 22 and 26, respectively.

Figure 6:
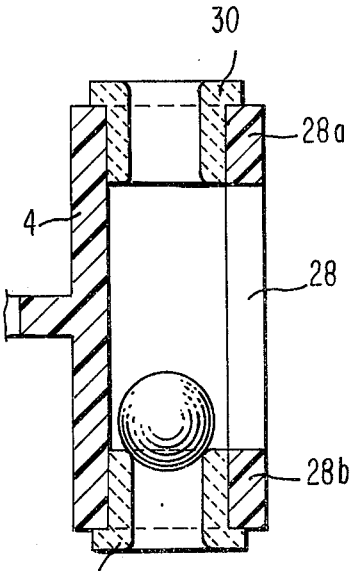

In the modification of FIG. 6, the slot 28 is formed so that its ends are spaced from the upper and lower ends of the housing to provide rings 28*a* and 28*b* within which inserts 30 and 32 are received, respectively.

It will be noted that the present device is very economical to make since the size of the housing is minimal in relation to the size of the ball being used.

In the modification of FIG. 4, the internal diameter of the housing, at the lower end of its passageway, has also been increased slightly, as at 14*a*, thereby to provide an annular shoulder 15*a* therein. A straight sided and shoulderless ceramic yarn eye guide insert 16*a* is received into such increased diameter section 14*a* and abuts the shoulder 15*a* thereof.

It will be noted that the present yarn tensioning device may occupy two positions in which it is equally effective, one such position being that shown in the drawings with the ball resting atop the insert 8, and the other such position being occupied when the device is reversed, end over end, so that the ball then rests atop the insert 10.

I claim:

1. A yarn tensioning device having a housing, said housing having a yarn passageway of predetermined length extending vertically therethrough, spaced upper and lower inserts received within the upper and the lower ends of said passageway, respectively, each of said inserts an uninterrupted wall providing an uninterrupted opening extending therethrough for the passage of yarn, said lower insert being provided with an uninterrupted circularly shaped seat around its said opening, a ball received within said passageway and between said inserts in seated position upon said seat in said lower insert, the relative dimensions of said ball, of said lower insert and of said passageway being such that lateral movement of said ball is restrained by the surface of said passageway thereby to retain said ball in its said seated position upon said lower insert, and said housing having an aperture extending therethrough in communication with said passageway, said aperture being disposed between said inserts, whereby said device may be threaded by threading the yarn in turn through said aperture and through said openings in each of said inserts.

2. Device as in claim 1 wherein said openings in said inserts are of similar size.

3. Device as in claim 1 wherein said threading of the yarn through said aperture and through said opening in at least one of said inserts is along a straight line.

4. Device as in claim 1 wherein said aperture in said housing is a slot extending lengthwise of said passageway.

5. Device as in claim 4 wherein said slot in said housing extends to at least one end of said passageway.

6. Device as in claim 1 wherein said passageway is cylindrically shaped and is of uniform diameter throughout its said length.

7. Device as in claim 1 wherein said upper and lower inserts are received within said passageway from the upper and the lower ends thereof, respectively.

* * * * *

UNITED STATES PATENT OFFICE

CERTIFICATE OF CORRECTION

Patent No. 4,030,684 Dated June 21, 1977

Inventor(s) Nathan Levin

It is certified that error appears in the above-identified patent and that said Letters Patent are hereby corrected as shown below:

Claim 1, Column 4, line 19, after "inserts" should read -- having --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*